United States Patent [19]

Murakami et al.

[11] 4,434,976

[45] Mar. 6, 1984

[54] CONCENTRIC MULTI-TUBE-SYSTEM NOZZLE SITUATED BENEATH THE SURFACE OF THE MELT IN A REFINING VESSEL

[75] Inventors: Shozo Murakami; Hiroyuki Aoki; Saburo Matsuo; Eiji Ikezaki; Kenji Yamaura, all of Kitakyushu, Japan

[73] Assignee: Nippon Steel Corporation, Tokyo, Japan

[21] Appl. No.: 448,325

[22] Filed: Dec. 9, 1982

[30] Foreign Application Priority Data

Dec. 11, 1981 [JP] Japan ..... 56-199615

[51] Int. Cl.[3] ..... C21B 7/16

[52] U.S. Cl. ..... 266/268; 266/270; 138/42; 239/553; 239/590

[58] Field of Search ..... 266/218, 225, 268, 270; 75/60; 239/424.5, 553, 590; 138/42, 173

[56] References Cited

U.S. PATENT DOCUMENTS

| | | | |
|---|---|---|---|
| 1,762,166 | 6/1930 | Fausek et al. | 239/424.5 |
| 3,703,279 | 11/1972 | Saccomano et al. | 266/268 |
| 3,779,534 | 12/1973 | Leroy et al. | 266/268 |
| 4,182,581 | 1/1980 | Uehara et al. | 138/173 |
| 4,249,719 | 2/1981 | Knuppel et al. | 266/268 |

FOREIGN PATENT DOCUMENTS

| | | | |
|---|---|---|---|
| 744978 | 1/1970 | France | 266/268 |

*Primary Examiner*—L. Dewayne Rutledge
*Assistant Examiner*—Robert McDowell
*Attorney, Agent, or Firm*—Cushman, Darby & Cushman

[57] ABSTRACT

The present invention relates to a concentric multi-tube-system nozzle situated beneath the surface of the melt in a refining vessel, especially a refining vessel for converting molten pig iron into steel.

The stability and life of the concentric double-tube nozzle is the most crucial factor in carrying out refining in a bottom-blown converter.

In accordance with the present invention, there is provided a concentric multi-tube-system nozzle situated beneath the surface of the melt in a refining vessel, comprising:

an inner tube;

an outer tube positioned concentrically with respect to the inner tube and forming an annular clearance between the inner tube and the outer tube;

spacers for circumferentially dividing the annular clearance; and a section defined by two adjacent spacers, the section comprising a contraction portion which is positioned essentially at the upstream side of the section. The contraction portion contributes to a uniform cooling of concentric double-tube nozzle in the circumference thereof.

6 Claims, 7 Drawing Figures

Figure 1A:
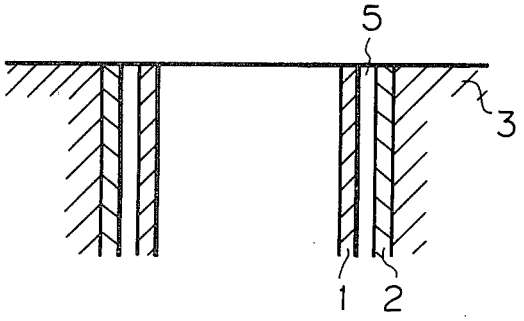
Fig. 1a PRIOR ART

CONCENTRIC MULTI-TUBE-SYSTEM NOZZLE SITUATED BENEATH THE SURFACE OF THE MELT IN A REFINING VESSEL

The present invention relates to a concentric multi-tube-system nozzle situated beneath the surface of the melt in a refining vessel, especially a refining vessel for converting molten pig iron into steel.

As is known, a concentric multi-tube-system nozzle, e.g., a concentric double-tube-system nozzle (hereinafter referred to as a concentric double-tube nozzle), is situated beneath the surface of the melt in a pure oxygen bottom-blown converter which is referred to as OBM, Q-BOP, or LWS. OBM or the like is operated on an industrial scale so as to enhance the efficiency of refining molten pig iron into steel.

In addition, according to a so-called combined blowing method, a concentric double-tube nozzle is situated beneath the surface of the melt in a conventional top-blown converter, i.e., a so-called LD converter, so as to intensify stirring of the melt and thus intensify the refining reaction efficiency by blowing pure oxygen, carbon dioxide gas, a mixture of pure oxygen and carbon dioxide gas, or an inert gas, such as argon or nitrogen, into the bath.

Not only blowing oxygen or the like into the bath of a converter but also various methods of blowing oxygen or the like into the bath in a refining vessel through a concentric double-tube-system nozzle situated beneath the surface of the melt in a refining vessel have been proposed. In these methods, usually one or more concentric double-tube nozzles are situated in the bottom of the refining vessel.

The stability of and the life of a concentric double-tube nozzle are the most crucial factors in carrying out refining in a bottom-blown converter, as well as in a refining vessel in which a combined blowing method is carried out.

Figure 1C:
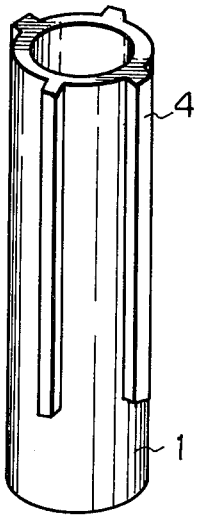
Figure 1B:
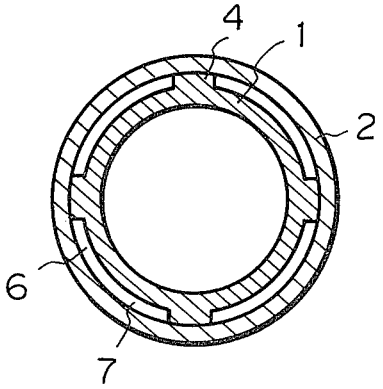
Figure 2A:
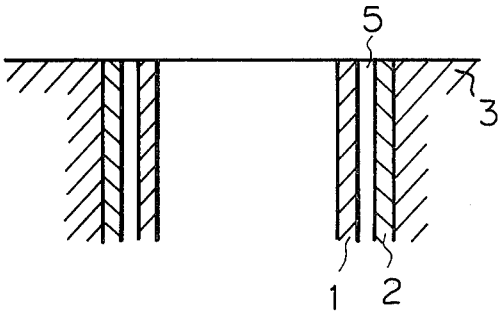
Figure 2C:
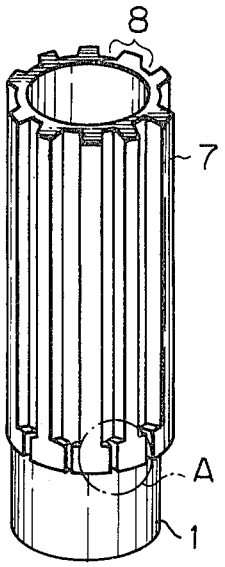
Figure 2B:
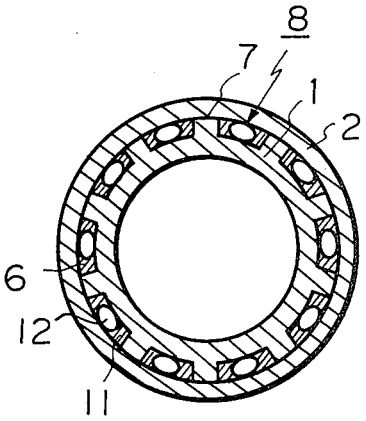
Figure 2D:
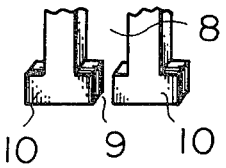

In the drawings:

FIG. 1*a* is a longitudinal cross-sectional view of the top part of a conventional concentric double-tube nozzle situated at the bottom of a refining vessel;

FIG. 1*b* is a traversal cross-sectional view of the conventional concentric double-tube nozzle of FIG. 1*a* through which oxygen or the like is blown;

FIG. 1*c* is a view of the inner tube of the conventional concentric double-tube nozzle of FIG. 1*a* having spacers on the outer wall thereof;

FIGS. 2*a* through 2*c*, which are similar to FIGS. 1*a* through 1*c*, respectively, illustrate an embodiment of the present invention; and FIG. 2*d* is an enlarged view of "A" in FIG. 2*c*.

The concentric double-tube nozzle shown in FIGS. 1*a* through *c* is similar to that disclosed in Japanese Examined Patent Publication Nos. 49-21002 and 54-20443 and is composed of an inner tube 1 and outer tube 2. A cooling gas is introduced into an annular clearance 5 between the outer tube 2 and the inner tube 1 through a conduit connected to the source of the cooling gas. Single gas, such as pure oxygen, air, carbon dioxide gas, argon and nitrogen, or mixed gas of pure oxygen with carbon dioxide gas and nitrogen, is introduced through the inner tube 1. The top part of the outer tube 2 is surrounded by a refractory lining 3. The inner tube 2 and the outer tube 3 are made of stainless steel, copper, or mild steel and have usually the thickness of from 2 to 5 mm.

As is shown in FIG. 1*b*, spacers 4 are formed on the outer wall of the inner tube 1 so as to stably form the annular clearance 5 when a concentric double-tube nozzle is installed in a refining vessel.

The stability and life of the conventional double-tube nozzle is unsatisfactory mainly because the mushroom, described hereinbelow, cannot be stably maintained during refining process.

It is an object of the present invention to provide a concentric multi-tube-system nozzle which is situated beneath the surface of the melt in a refining vessel, e.g., a bottom-blown converter or a vessel for carrying out a combined blowing method, and through which a cooling gas is introduced into an annular clearance formed between an inner tube and an outer tube, the life of the nozzle being considerably prolonged and the stability of the life is enhanced due to the shape of the spacers thereof.

The manner in which the inventors completed the present invention is now described with regard to a concentric double-tube nozzle.

When the top end of a concentric double-tube nozzle is in direct contact with molten steel of a considerably high temperature, there is the possibility of the top end melting and dissolving in the molten steel, and when it is exposed to an intense molten steel movement created by the blowing jets, erosion occurs to some extent. In addition, when the top end is subjected to molten steel having an extremely high temperature, both the top end and portions of the refractory lining surrounding the top end may wear out. However, the degree to which the top end and the portions of the refractory lining surrounding the top end are worn out is lessened for the following reasons: solidifying porous metal (the so-called mushroom) which is deposited at the top end of a concentric double-tube nozzle shields the top end and portions of the refractory lining surrounding the top end from the molten steel; the gases which are introduced into a concentric double-tube nozzle cool the nozzle itself; and the cooling gas cools the mushroom when it is blown through the micropores in the mushroom.

Since the effect of the cooling gas is considerably enhanced by the presence of the mushroom, the life of a concentric double-tube nozzle is considerably prolonged if the mushroom is stably maintained during refining.

In order to stably maintain the mushroom when it is brought into direct contact with molten steel of a considerably high temperature, it is necessary to uniformly distribute the cooling gas in the annular clearance so that the mushroom is effectively cooled.

As is mentioned hereinabove, the gases which are introduced into a concentric double-tube nozzle cool the nozzle itself. Particularly, the cooling gas directly cools the concentric double-tube nozzle, which is subjected to the sensible heat of the molten steel and to heat generated due to an exothermic reaction between the molten steel and a reactive gas introduced through the inner tube. However, the direct cooling effect of the cooling gas is unsatisfactory in a conventional concentric double-tube nozzle because of nonuniform distribution of the cooling gas.

The present inventors conducted refining experiments in which a plurality of concentric double-tube nozzles, each of which was comprised of an inner tube and an outer tube, were used. Conventional spacers were spot welded to the outer wall of each inner tube so as to stably form an annular clearance between the inner tubes and the outer tubes.

As a result of the experiments, it was found that the concentric double-tube nozzles involved series problems in that: (1) the pressure of the gases introduced thereinto greatly varied in the inner and outer tubes during the blowing period; (2) the shape of and the dimension of the mushroom greatly varied from heat to heat; and (3) the erosion rate of the concentric double-tube nozzles was high.

The shape of and the dimension of the mushroom were observed after tapping of the molten steel, and it was revealed that, in addition to the above-mentioned variation in the shape of and the dimension of the mushroom, the mushroom was not concentrically formed around the inner tube, thereby creating the possibility of the shape of the mushroom becoming eccentric or irregular. These findings indicated that active renewal of the mushroom took place during refining.

In their refining experiments, the present inventors discovered that when the mushroom was renewed very frequently, i.e., when the life of the mushroom was short, portions of the refractory lining surrounding and adjacent to the top end of each of the concentric double-tube nozzles were not shielded by the mushroom and became considerably eroded during renewal of the mushroom.

Observation of the shape of and the dimension of the mushroom also revealed that when the dimension of the mushroom became very small, a new mushroom was not formed for a long period of time, with the result that the top end of each of the concentric double-tube nozzles was continually exposed to the molten steel. This is more serious than the short life of mushroom. Such exposure caused the concentric double-tube nozzles to erode more rapidly than during renewal of the mushroom and eventually caused extreme or abnormal erosion.

In the experiments, the present inventors removed and investigated the concentric double-tube nozzles in which extreme or abnormal erosion took place, and it was discovered that the refined metal had penetrated into the annular clearance of the concentric double-tube nozzles. It was also discovered that since the refined metal was not uniformly distributed in the annular clearance, that is, it was locally present as seen along the circumference of the annular clearance, portions of the annular clearance became plugged, with the result that passage of the cooling gas was hindered and therefore the cooling gas was effective only locally in the annular clearance.

Furthermore, when portions of the mushroom in which the effect of the cooling gas was unsatisfactory were exposed to the sensible heat of the molten steel and to heat generated due to an exothermic reaction between the molten steel and a reactive gas introduced through the inner tube, the mushroom fused and then diminished.

Also, when the plugged portions of the annular clearance were heated to a temperature higher than the critical temperature at which, for example, the plugged portions ignited in the presence of oxygen introduced through the inner tube, the top end of the concentric double-tube nozzles occasionally burned out, and, finally, the mushroom spalled off or excessive or abnormal erosion of the concentric double-tube nozzles took place.

The present inventors therefore considered that in order to achieve the above-mentioned object of the present invention, local plugging of the annular clearances due to the penetration of refined metal thereinto should be essentially prevented or controlled so as to achieve uniform cooling along the circumference of the annular clearance. Ideally, local plugging should be essentially prevented, and, therefore, the present inventors considered a method in which the annular clearance can be diminished and thereby the pressure of the ejected cooling gas can be enhanced at the top end of the annular clearance.

In this method, a narrow annular clearance is formed in the wear portion of the concentric double-tube nozzle, which portion wears out during the life of the nozzle. The wear portion usually has a length of 1 m or more, and when it wears out, the top end of the concentric double-tube nozzle gradually descends to the bottom of the refining vessel.

However, this method in which the annular clearance can be diminished is not practical because when the cooling gas blows through the annular clearance, a considerable drop in pressure takes place due to the length of the concentric double-tube nozzle and the narrow annular clearance.

In the refining experiments carried out by the present inventors, the portions of annular clearance into which the refined metal did not penetrate corresponded to from 20% to 30% of the cross sectional area of annular clearance. Also, regarding the flow rate of the cooling gas during refining, the pressure of the ejected cooling gas at the top end of the annular clearance was presumably from 5 to 8 kg/cm$^2$ considering from the width mentioned above. This value was considerably higher than the ferrostatic pressure of the molten steel, which was approximately 1.5 kg/cm$^2$, and was no practical.

The present inventors found that when the pressure of the ejected cooling gas was further enhanced, the high pressure at the cooling gas source rendered maintenance of the cooling-gas supply system difficult and also caused safety problems. Furthermore, it was found that the pressure of the ejected cooling gas and the pressure of the gas ejected from the inner tube were so unbalanced that a countercurrent of the cooling gas was created in the inner tube, thereby creating very dangerous circumstances.

The present inventors therefore realized that in order to achieve the object of the present invention mentioned above, a method for controlling rather than essentially preventing local plugging of the annular clearance must be provided.

In a conventional concentric double-tube nozzle, as is described hereinabove with reference to FIGS. 1*a* through 1*c*, the spacers 4 are formed on the inner wall of the inner tube 1 so as to stably form the annular clearance 5. The usually number of spacers 4 formed in each inner tube 1 is three or four, the spacers normally being rib shaped. Since the spacers can neither prevent nor control the formation of a mushroom, the mushroom cannot be stably maintained during refining.

In accordance with the present invention, now described, there is provided a concentric multi-tube-system nozzle situated beneath the surface of the melt in a refining vessel, the nozzle comprising:

an inner tube;

an outer tube positioned concentrically with respect to the inner tube and forming an annular clearance between the inner tube and the outer tube;

spacers for circumferentially dividing the annular clearance; and a section defined by two adjacent spacers, the section comprising a contraction portion which is positioned essentially at the bottom of the section in the flow direction of the cooling gas which is introduced into the section.

In an embodiment of the present invention, the cross-sectional area of the contraction portion relative to that of the section is from 30% to 70%.

In another embodiment of the present invention, the number of spacers is from $\pi D/15$ to $\pi D/5$, wherein D is the outer diameter of the inner tube, in mm.

In a further embodiment of the present invention, the spacers are formed over a length of from approximately 300 mm to approximately 3 meters.

In yet a further embodiment of the present invention, the annular clearance has a width of from 0.5 mm to 3 mm.

In still another embodiment of the present invention, the outer tube has an inner diameter of approximately 5 mm to approximately 50 mm.

A preferred embodiment of the present invention is described with reference to FIGS. 2*a* through 2*d*.

As is shown in FIG. 2*b*, ten spacers 7, divide the annular clearance 5 into ten sections 8. The spacers 7 formed on the outer wall of the inner tube 1 are each in the form of a rib and are hereinafter referred to as the ribs 7. At the upstream side or lower end of each section 8 (FIG. 2*d*), a slit 9, i.e., an example of the contraction portion, is defined by the opposed two lugs 10, and the cooling gas is introduced into the section 8 via the slit 9, with the result that the cooling gas can be uniformly distributed in all of the sections 8.

The width of the ribs 7 determine the distance between the neighboring two sections 8 and determines to what extent the cooling gas cools the top end of the concentric double-tube nozzle by means of thermal conduction or heat withdrawal through the ribs 7. In order to effectively achieve such heat withdrawal and thus to make the concentric double-tube nozzle resistant to, for example, the combustion by oxygen, introduced through the inner tube 1, the width of the sections 8 should not exceed a certain maximum value. The number of and width of the ribs 7 determine the ratio of the cross-sectional area of the sections 8 to that of a region of the annular clearance where the ribs 7 are not formed and also determine how uniformly the cooling gas is distributed in all of the sections 8 while keeping the amount of refined metal which penetrates into these sections small.

The term "contraction ratio" used herein means the ratio of the cross-sectional area of each contraction portion to that of each section 8 and should be controlled in accordance with the penetration ratio, as is described hereinbelow. The term "penetration ratio" used herein means the following:

$$\frac{A-B}{A} \times 100\%,$$

wherein A is the total cross-sectional area of the sections 8 and B is the total cross-sectional area of apertures 12 of the sections 8, into which sections the refined metal 11 pentrates.

The contraction ratio is important for uniform cooling of concentric double-tube nozzle along the circumference thereof. Influences exerted by the contraction portion seem to be complicated. That is, the contraction portion changes: the interference between the cooling gas and the gas introduced through the inner tube 1 at the top end of the concentric double-tube nozzle, changes the extent to which the top end of the concentric double-tube nozzle is exposed to the molten steel when mushroom renewal takes place, and changes the ignition of top tube the presence of oxygen.

The contraction portion of each section 8 may be defined by at least one slit 9.

The contraction ratio which is preferable for achieving uniform distribution of the cooling gas in each section 8 of one concentric double tube nozzle is now described. If the pressure drop at the contraction portion is equal to or higher than the critical pressure ratio, uniform distribution of the cooling gas can be achieved. The term "critical pressure ratio" herein means the following:

$$P_1/P_0 = P_c/P_0 = \left(\frac{2}{k+1}\right)^{k/k-1},$$

wherein $P_0$ (kg/cm$^2$) is the pressure of the cooling gas upstream of the contraction portion as seen in the flow direction of the cooling gas, $P_1$ (kg/cm$^2$) is the ejection pressure of the cooling gas ejected from the contraction portion, $P_c$ (kg/cm$^2$) is the pressure of the cooling gas which is pressurized until its flow speed in the contraction portion is equal to the sound velocity, and k is a constant and is $C_p/C_v$, $C_p$ and $C_v$ being a specific heat at a constant pressure and a specific heat at a constant volume of the cooling gas, respectively. $P_2$ (kg/cm$^2$) is the pressure of the cooling gas flowing through the section behind the contraction portion. In order to make the pressure drop $P_2$-$P_1$ the contraction portion, e.g., the slit 9, equal to the critical pressure ratio, the slit 9 must be very small, and, thus, the pressure of the gas-supply source must be very high, which is disadvantageous, as is described hereinabove, and thus is not practical.

In their experiments of the present inventors, the slit 9 was made gradually smaller while preventing an excessive increase in the pressure of the gas-supply source, and the relationship between the penetration of refined metal and the formation of apertures 12 (FIG. 2*b*) was investigated.

According to a discovery of the present inventors, when the contraction ratio is equal to or greater than the penetration ratio, the cooling gas is very uniformly distributed in each section 8 and thus the ratio of the cross-sectional area of each slit 9 to the cross-sectional area of the apertures 12 of each section 8, into which the refined metal 11 penetrates, (hereinafter referred to as the effective contraction ratio) is not very high, with the result that the pressure drop in the slit 9 is small. In addition, even if the refined metal 11 partially plugs one or more of the sections 8, the effective cross-sectional area of each of the sections 8, i.e., the cross-sectional area of each of the apertures 12, tends to be equal, with the result that the cooling gas is uniformly distributed in each of the sections 8.

It is preferred that the following three parameters be simultaneously controlled in the ranges given below:

1. Number of ribs 7: from $\pi D/15$ to $\pi D/5$, wherein D is the outer diameter of the inner tube 1

2. Ratio (hereinafter referred to as the spacer ratio) of the total width of the ribs 7 to the circumference of the annular clearance 5, which ratio determines the contraction degree of the cooling gas contracted by the ribs 7: from 30% to 70%.

3. Contraction ratio: from 30% to 70%.

When the above three parameters are simultaneously maintained, the cooling gas is extremely uniformly distributed in each section 8. More specifically, the amount of plugging by the refined metal 11 is virtually the same in all of the sections 8. When one or more of the sections 8 become more plugged than the other sections 8, the pressure of the ejected cooling gas in the more plugged section or sections 8 is thereby enhanced and enlarges the apertures 12 of the section or sections 8 are enlarged until they are equal in size to the apertures 12 of the less plugged sections 8. In other words, since the pressure of the ejected cooling gas in the more plugged section or sections 8 is higher than that in the less plugged sections 8, the dimensions of the apertures 12 are automatically equalized. In such a case, it is necessary to increase the flow rate of cooling gas so as to uniformly distribute the cooling gas.

When the number of ribs 7 is less than $\pi D/15$, the distance between the neighboring two ribs 7 is so large that the aperture 12 in each section 8 is positioned near either of the neighboring two ribs 7 and thus cooling of the top end of the concentric double-tube nozzle becomes nonuniform. The number of ribs 7 is more than $\pi D/5$, is not necessary for achieving uniform cooling of the top end of the concentric double-tube nozzle. However, it is difficult to manufacture so many ribs 7 by, for example, machining.

When the spacer ratio is less than 30%, the distance between the pluggings in the neighboring sections 8 exceed the maximum value for keeping uniform cooling of the top end of the concentric double-tube nozzle. When the spacer ratio is more than 70%, the slits 9 may not be effective.

When the contraction ratio is less than 30%, one or more of the sections 8 may be come completely plugged. That is, there is a possibility that an aperture 12 will not be formed in one or more of the sections 8. When the contraction ratio is more than 70%, the pressure at the gas-supply source tends to be high. Although in FIG. **2*b* one aperture 12 is shown in each section 8, a plurality of apertures may be formed in each section 8. Conventionally, the flow rate characteristic of the cooling gas is appreciably varied depending on the accuracy of machining of the spacers 7, with the result that a plurality of concentric double-tube nozzles are worn out non-uniformly due to a difference in the flow rate characteristic of the cooling gas. Additionally, according to a known method, in order to achieve uniform gas flow rate in each concentric double-tube nozzle, and also to suppress an increase in the pressure of the gas-supply-source to the minimum value an orifice is situated in a portion of the main gas-supply conduit where a plurality of conduits are branched off, and the pressure is controlled by the orifice at a value higher than the critical pressure ratio. According to the present invention, the slits 9** contribute to uniform wear of a plurality of concentric double-tube nozzles and make the formation of an orifice unnecessary.

Although a preferred embodiment has been described with reference to FIGS. 2A through 2D, it should be understood that certain modifications are included in the present invention. That is, the ribs 7 may be extended spirally and may be formed on the inner wall of outer tube 2, the sections 8 may be slightly tapered or enlarged, and the length of the lugs 10 may be adjusted.

The present invention is now explained by way of an example.

A 320-ton top-blown converter was provided with five concentric double-tube nozzles situated at the bottom thereof.

Oxygen was blown through the top-blow lance, and oxygen and propane, i.e., cooling gases, were introduced through the inner and outer tubes of the concentric double-tube nozzles. The amount of bottom-blown oxygen was approximately 6% based on the total oxygen amount of blown according to the top-blown and bottom-blown methods. In experimental heats the steel produced was totally continuously cast. The temperature of the molten steel was approximately 1650° C. on the average at the end of blowing. The inner and outer tubes of the concentric double-tube nozzles were made of stainless steel, and the outer diameter of the inner tubes was 30 mm. The inner tubes were machined so as to form ten sections. The width of each section was 6.4 mm, and the height and width of each rib were 1.0 mm and 3.0 mm, respectively. The spacer ratio was 32%.

The top-blown and bottom-blown methods in which conventional concentric double-tube nozzles were used were carried out as described above, as were the top-blown and bottom-blown methods in which the concentric double-tube nozzles of the present invention was used. However, in the case of the concentric double-tube nozzles of the present invention, each of the ribs thereof was provided with lugs at the bottom thereof so that the contraction ratio was 50%.

The wear rate of and the life of the concentric double-tube nozzles are shown in the table below.

TABLE

| | Conventional Wear Length | | Invention Wear Length | |
|---|---|---|---|---|
| | 500 mm | 1000 mm | 500 mm | 1000 mm |
| Life of Nozzles | 407 heats | 814 heats | 610 heats | 1220 heats |
| Wear Rate | 1.22 mm/heat | | 0.82 mm/heat | |

As is apparent from the table, the life of the concentric double-tube nozzles of the present invention was longer than that of the conventional concentric double-tube nozzles.

The stability of the mushroom was very high in the nozzles of the present invention as compared with that in the conventional concentric double-tube nozzles. In the latter case, the mushroom was extremely small, was formed eccentrically around the nozzles, and was present for a considerably long period of time. In addition, variation of the pressure of the gases which were introduced through the inner and outer tubes of the concentric double-tube nozzles of the present invention was very small. Furthermore, the erosion rate was very uniform with regard to five of the concentric double-tube nozzles of the present invention.

We claim:

1. A concentric multi-tube-system nozzle situated beneath the surface of the melt in a refining vessel, comprising:

an inner tube;

an outer tube positioned concentrically with respect to the inner tube and forming an annular clearance between the inner tube and the outer tube;

spacers for circumferentially dividing the annular clearance; and a section defined by two adjacent spacers, said section comprising a contraction portion which is positioned essentially at the bottom of said section in the flow direction of cooling gas which is introduced into the section.

2. A concentric multi-tube-system nozzle according to claim 1, wherein the cross-sectional area of said contraction portion relative to that of said section is from 30 to 70%.

3. A concentric multi-tube-system nozzle according to claim 1, wherein the number of spacers is from $\pi D/15$ to $\pi D/5$ wherein D is the outer diameter of inner tube.

4. A concentric multi-tube-system nozzle according to claim 1, wherein said spacers are formed over a length of from approximately 300 mm to approximately 3 m.

5. A concentric multi-tube-system nozzle according to claim 1, wherein said annular clearance has a width of from 0.5 to 3 mm.

6. A concentric multi-tube-system nozzle according to claim 1, wherein said outer tube has an inner diameter of approximately 5 mm to approximately 50 mm.

* * * * *